US005648750A

United States Patent [19]

Yuza et al.

[11] Patent Number: 5,648,750

[45] Date of Patent: Jul. 15, 1997

[54] SURFACE-MOUNT TYPE MICROMINIATURE ELECTRIC CURRENT FUSE

[75] Inventors: Yasutada Yuza; Yuichi Sato, both of Tochigi-ken, Japan

[73] Assignee: Soc Corporation, Tokyo, Japan

[21] Appl. No.: 596,010

[22] Filed: Feb. 6, 1996

[30] Foreign Application Priority Data

Aug. 30, 1995 [JP] Japan ..... 7-221651

[51] Int. Cl.[6] ..... H01H 85/00

[52] U.S. Cl. ..... 337/295; 337/252; 337/416

[58] Field of Search ..... 337/401–408, 337/416, 290, 295, 252

[56] References Cited

U.S. PATENT DOCUMENTS 4,527,144 7/1985 Arikawa ..... 337/407

4,559,514 12/1985 Arikawa ..... 337/201

FOREIGN PATENT DOCUMENTS 0370572 5/1990 European Pat. Off. .

*Primary Examiner*—Leo P. Picard

*Assistant Examiner*—Jayprakash N. Gandhi

*Attorney, Agent, or Firm*—Wenderoth, Lind & Ponack

[57] ABSTRACT

A pair of metallic electrodes gripping a fusible wire are attached to opposite ends of a box-like shaped body into which is pressed a lid portion to an extent to be slightly sunken relative to an upper surface of the body. Then adhesive is applied to the lid portion to fix the lid portion to the body to seal the interior of the body. The fusible wire is extended in the interior of the body in a floating condition. Such a construction allows easy manufacture, enables variation of pre-arcing time-current characteristic to be kept to minimum, and brings about a high degree of reliability.

2 Claims, 4 Drawing Sheets

SURFACE-MOUNT TYPE MICROMINIATURE ELECTRIC CURRENT FUSE

BACKGROUND OF THE INVENTION

1. Field of the Invention

The present invention relates to a microminiature electric current fuse which can be mounted on the surface of a printed circuit substrate to cope with microminiaturization technology of a circuit for electronics and high density of electronic elements mounted on the circuit.

2. Description of Prior Art

The following surface-mount type micro sized electric current fuses according to a prior art have been developed. One example is that which has been developed for the purpose of miniaturization, wherein a fusible part composed of a metallic film is formed on an insulating substrate and subsequently the metallic film constituting this fusible part is embedded in a low melting point glass or plastic material. Another example of a micro sized electric current fuse which has been developed at a low cost is constructed such that after the fusible wire has been connected between metallic electrodes by means of bonding or the like, the fusible wire is integrally molded together with a fuse body in such a manner as to be embedded in the plastic material. However, since a surface-mount type micro sized electric current fuse having such a construction as described above has been developed solely with a view to miniaturization and reduction of cost, the fusible part or the fusible wire (hereinafter collectively referred as "fusible part") comes into direct contact with an insulating member such as a plastic material, low melting point glass or the like, resulting in an inability of the fusible part to maintain thermal neutrality and poor pre-arcing time-current characteristics.

More specifically, such a construction whereby the fusible part comes into direct contact with the insulating material requires a large amount of exoergic action since, when Joule heat is generated at the fusible part due to a flow of abnormal current due to circuit failure or the like of an electronic device, such Joule heat is directly absorbed by the insulating material, resulting in a delay in cutting off such an abnormal current and heating of the insulating material itself with which the fusible part is in contact.

Consequently, a more exoergic action than necessary is required for heading the fusible part so that the internal resistance of the fusible element itself has to be increased and as a result, under normal use conditions, the electric loss on the electric circuit caused by the fusible element alone is considerable and an exoergic action of the fuse element has to be large.

Another example of a microminiature electric current fuse which has been developed in order to attain a higher reliability is constructed such that, after electrodes have been disposed in and fixed to a casing, a fusible wire is extended between the electrodes and soldered thereto and after that an opening is tightly closed by means of a lid. However, it has to be pointed out that, according to the method of soldering the fusible wire to the electrodes, the difference in bulging of the solder upon solidification may cause a variation in a distance between the electrodes or the length of the fusible wire. Such a problem of variation has yet to be solved.

In addition, since the above-mentioned prior art miniature or microminiature electric current fuse requires each component to be machined and assembled one by one in a batch-type process and such machining and assembly operations are difficult due to such components being small or production being difficult to execute, costs have remained relatively high.

SUMMARY OF THE INVENTION

An object of the present invention is, therefore, to provide a surface-mount type microminiature electric current fuse which solves the problems pointed out above, has a construction which allows easy manufacture, minimizes variation in pre-arcing time, and is highly reliable.

In order to attain the object mentioned above, a surface-mount type microminiature electric current fuse according to the present invention comprises a body having a substantially rectangular parallelepiped box like configuration having two opposing shorter side walls, two opposing longer side walls and a bottom part, the body being made of a heat resistant, electrically insulating material and having resting portions, each of which extends from an inner surface of each of the longer side walls of the body toward a space defined in the body and forming a stepped portion relative to top surfaces of the longer side walls. A fusible wire is held by a pair of metallic electrodes formed of respective integral metallic sheets and disposed at the shorter side walls of the body. A lid portion is made of a heat resistant and electrically insulating material. The cross-section of the lid portion has a convex shape to be fitted in an opening of the body. Each of the metallic electrodes includes a saddle part having a saddle shape to fit onto the top surface and the both side surfaces of the respective shorter side wall of the body, and a fusible wire gripping part extending from an end portion of the saddle part at the side facing the space of the body into the space. The width of the fusible wire gripping part is narrower than the width of the end portion of the saddle part, and saddle part of the metallic electrode is fitted onto the shorter side wall of the body. The fusible wire gripping part has a first sheet portion extending within the space, and a second sheet portion which is bent and extends from the first sheet portion in a direction different from the direction of the first sheet portion extending in the space and cooperates with the first sheet portion so as to grip the end of the fusible wire. The pair of metallic electrodes gripping the opposite ends of said fusible wire with the fusible wire gripping parts are respectively disposed at the shorter side walls of the body so that the opposite ends of the fusible wire are gripped by the fusible wire gripping parts so as to extend the fusible wire through the space of the body. The lid portion is pressed to such an extent that a flat surface of the lid portion is sunken to a location slightly lower relative to the top surface of the longer side walls of the body. Two flat planar surfaces of the convex portion of the lid portion are respectively placed on upper surfaces of the resting portions of the body, and an adhesive is applied therebetween so that the space of the body is sealed and the lid portion is fixed to the body. Each of the metallic electrodes is sandwiched and fixed by the inner surface of the respective shorter side wall and a respective end surface of the lid portion in the longitudinal direction.

Since the surface-mount type microminiature electric current fuse according to the present invention is constructed as described above, manufacturing and assembly operations can be made continuous, thus allowing efficient production. Accordingly, a considerable reduction in manufacturing costs can be realized.

The present invention has been provided to attain a micro size surface-mount type electric current fuse which can satisfy world-wide national standards required in the field of surface-mount type microminiature electric current fuses. A surface-mount type microminiature electric current fuse according to the present invention can attain thermal neutrality of the fusible wire so that its variation in pre-arcing time-current characteristic can be smaller than an other surface-mount type microminiature electric current fuse according to a prior art. In addition, the breaking capacity can be two times as large as conventional microminiature electric current fuses, making it possible for the microminiature electric current fuses to be used for both direct current and alternate current circuits. Furthermore, compared to a conventional type fuse capable of maintaining thermal neutrality, a fuse according to the present invention can provide a complete enclosure, making it possible to withstand warm water washing which takes the place of flon washing of a circuit substrate to prevent pollution.

The metallic electrodes can be mechanically fixed and electrically connected by soldering to pads of a circuit pattern on a circuit substrate. Further, the length of the fusible wire can be exactly maintained, and the fusible wire can be readily and accurately held in a floating condition between the bottom surface of the body and the backside surface of the lid portion. As a result, any variation of the pre-arcing time-current characteristic can be kept to a minimum.

The surface-mount type microminiature electric current fuse according to the present invention can meet conditions stipulated in Japanese Regulations for Electrical Appliances to the effect that the distance between the electrodes of a fuse to be used in an alternating current electric path should be more than 1.5 mm and a microminiatured but highly reliable electric fuse provided by the present invention can be applied to any alternating current and direct current circuits.

BRIEF DESCRIPTION OF THE DRAWINGS

The above and other objects and features of the invention will become more obvious hereinafter from a consideration of the following description taken in connection with the accompanying drawings, wherein.

DESCRIPTION OF THE PREFERRED EMBODIMENTS

Figure 1:
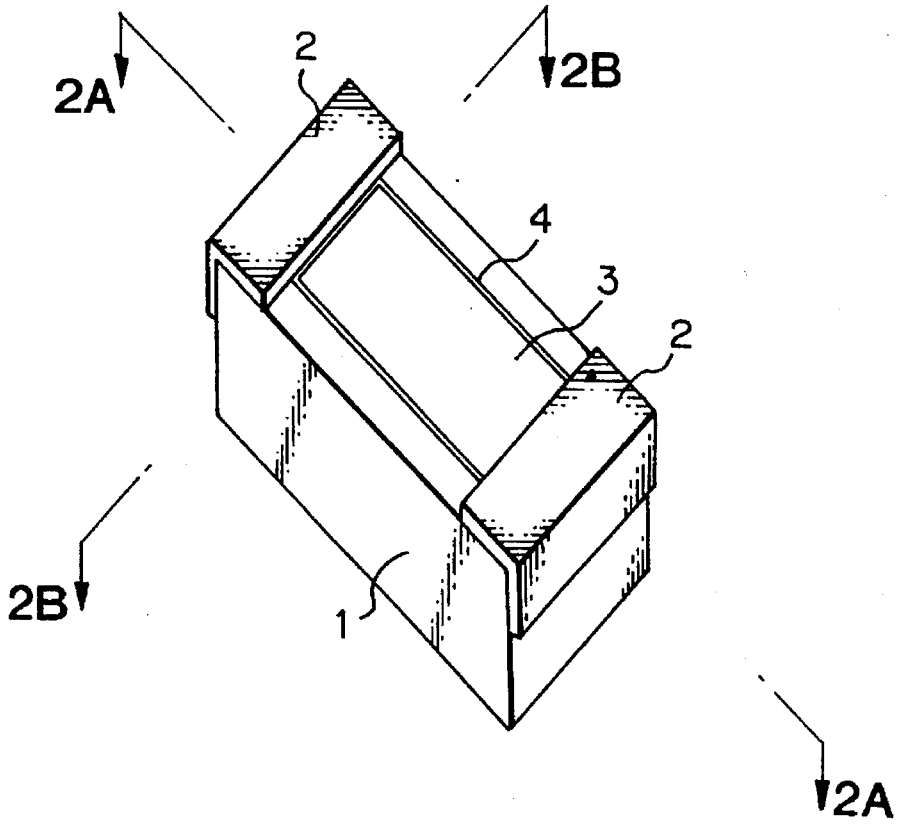
FIG. 1 is a perspective view illustrating the surface-mount type microminiature electric current fuse according to a first preferred embodiment of the present invention.

Preferred embodiments of the present invention will now be explained by referring to the accompanying drawings. Through the drawings, same reference numerals designate identical or similar elements.

Figure 2A:
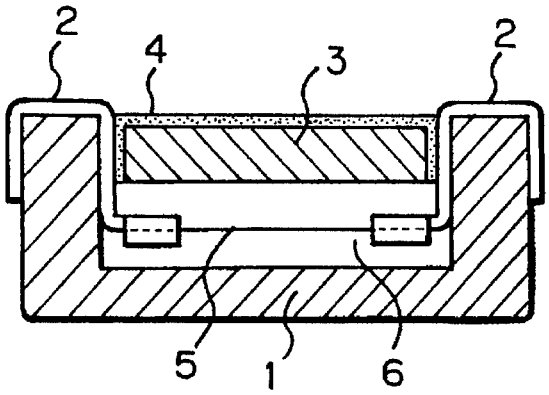
FIG. 2A is the sectional view taken along the line 2A—2A in FIG. 1.
Figure 2B:
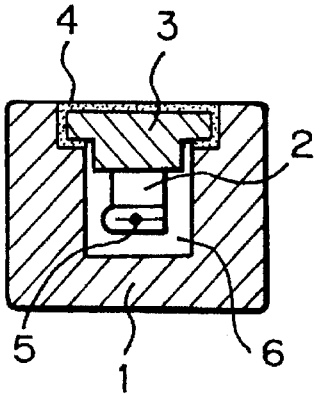
FIG. 2B is the sectional view taken along the line 2B—2B in FIG. 1.
Figure 3:
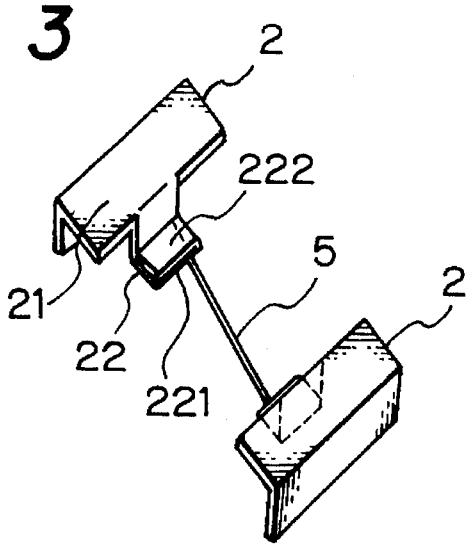
FIG. 3 illustrates a pair of metallic electrodes and a fusible wire which are components of the surface-mount type microminiature electric current fuse according to the first embodiment shown in FIG. 1, the opposite ends of the fusible wire being shown as gripped by the pair of the metallic electrodes.
Figure 4:
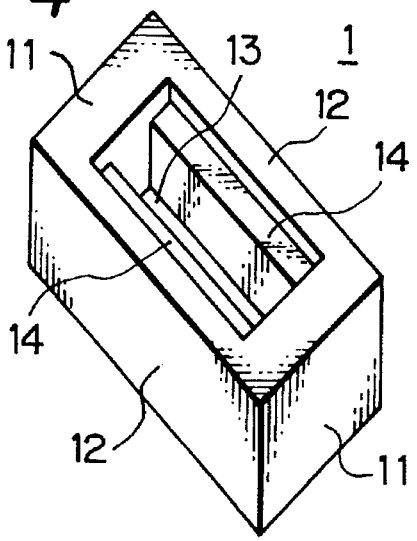
FIG. 4 is a perspective view showing a body which is a component of the surface-mount type microminiature electric current fuse according to the first embodiment shown in FIG. 1.
Figure 5:
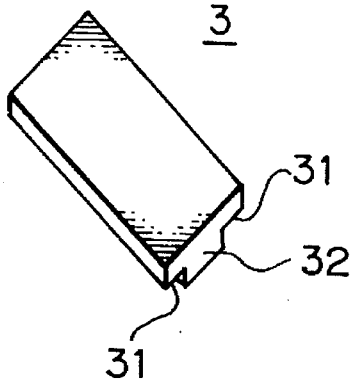
FIG. 5 is a perspective view showing a lid portion which is a component of the surface-mount type microminiature electric current fuse according to the first embodiment shown in FIG. 1.
Figure 6:
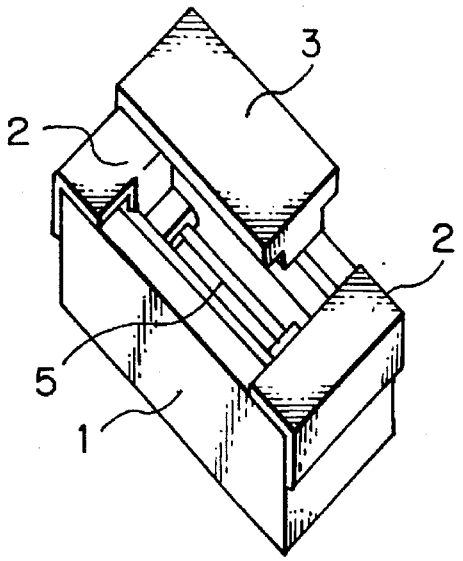
FIG. 6 is a perspective view showing the manner of assembly of the surface-mount type microminiature electric current fuse according to the first embodiment shown in FIG. 1.

FIG. 1 is a perspective view illustrating a surface-mount type microminiature electric current fuse according to a first preferred embodiment of the present invention. FIG. 2A is the sectional view taken along the line 2A—2A in FIG. 1 while FIG. 2B is the sectional view taken along the line 2B—2B in FIG. 1. FIG. 3 illustrates a pair of metallic electrodes and a fusible wire which are components of the surface-mount type microminiature electric current fuse according to the first embodiment of the present invention as shown in FIG. 1, the opposite end portions of the fusible wire being illustrated as gripped by the pair of metallic electrodes. FIG. 4 is a perspective view of a body which is a component of the surface-mount type microminiature electric current fuse according to the first embodiment as shown in FIG. 1. FIG. 5 is a perspective view of the lid portion which is a component of the surface-mount type microminiature electric current fuse according to the first embodiment shown in FIG. 1. FIG. 6 is a perspective view illustrating the manner of assembly of the surface-mount type microminiature electric current fuse according to the first embodiment as shown in FIG. 1.

In FIGS. 1–2B, the reference numeral 1 designates a body made of a heat resistant and electrically insulating material such as ceramics or the like and having a rectangular parallelepiped box-like configuration, the reference numeral 2 a pair of metallic electrodes attached respectively to each of the shorter side walls of the body 1 and made by working a metallic sheet, the reference numeral 3 a lid portion made of a heat resistant and electrically insulating material such as ceramic and adapted to fit in an opening of the body 1, the reference numeral 4 an adhesive material for adhering and fixing the lid portion 3 to the body 1 and hermetically enclosing the interior of the body 1, and the reference numeral 5 a fusible wire extended in the space 6 of the body 1 with the opposite end portions gripped by the metallic electrodes 2.

Referring to FIG. 4, the body 1 includes two opposing shorter side walls 11, two opposing longer side walls 12 and a bottom part 13. The inside surfaces of the respective longer side walls 12 include resting portions 14 which extend toward the space 6 of the body 1 and defining stepped portions relative to the top surfaces of the longer side walls 12.

Referring to FIG. 3, and FIGS. 2A and 2B, the metallic electrodes 2 are each made of an integral metallic sheet. Each electrode 2 includes a saddle part 21 having a saddle shaped configuration adaptable to the top surface and the opposite side surfaces of the shorter side wall 11 (FIG. 4) of the body 1, and a fusible wire gripping part 22 adapted to grip the end portion of the fusible wire 5. The width of a first portion of the saddle part 21 to be rested on the top surface of the shorter side wall 11 of the body 1 is equal to the width of a second portion of the saddle part 21 to be in contact with the outer surface of the shorter side wall 11, but the width of a third portion of the saddle part 21 to be in contact with the inner surface of the shorter side wall 11 is smaller than the width of the above-mentioned second portion. The third portion of the saddle part 21 is so arranged relative to the second portion of the saddle part 21 that it is positioned centrally of the shorter side wall 11 when the saddle part 21 is attached to the shorter side wall 11 of the body 1. The third portion of the saddle part 21 is provided with a first sheet portion 221 which is bent substantially normal to the second portion of the saddle part 21 from an end opposite to the second portion and extends in the same direction as the second portion of the saddle part 21. The width of the first sheet portion 221 is same as that of the third portion. A second sheet portion 222 extends from one end of the first sheet portion 221 in the width direction before the second sheet portion is worked in order to grip the fusible element 5. The second sheet portion 222 is bent from the end portion of the first sheet portion 221 in a manner to grip the end of the fusible wire 5 placed on the first sheet portion 221 and then is laid on the first sheet portion 221. By means of such operation, the end of the fusible element 5 is gripped between the first sheet portion 221 and the second sheet portion 222 and is secured to the metallic electrode 2. The size of the second sheet portion 222 is substantially same as that of the first sheet portion 221.

Referring to FIG. 5, the lid portion 3 has a cross section of a convex shaped configuration. The lid portion 3 is of such a size as to be fitted in the opening of the body 1 with the metallic electrodes 2 attached to the body 1. As shown in FIGS. 2B and 5, the lid portion 3 has flat surfaces 31 at the opposite sides of a protruded portion, the flat surfaces 31 being rested on the upper surfaces of the resting portions 14 of the body 1 when the lid portion 3 is fitted onto the opening of the body 1.

Next, reference is made to FIGS. 3 and 6. An example of manufacture and assembly of the surface-mount type microminiature electric current fuse according to the first preferred embodiment will be explained. A pair of metallic electrodes 2 are continuously press worked in the form of a frame. It is to be noted that the spaced distance between a pair of metallic electrodes 2 is decided to be the same as that between the opposite shorter side walls 11 of the body 1. In this condition, the respective end portions of the fusible wire 5 are placed on the first sheet portions 221 of the respective metallic electrodes 2, the second sheet portions 222 are folded onto the first sheet portions 221 to grip the end portions of the fusible wire 5. This step is executed as a continuous process. The bodies 1 are placed to one another in a manner as the longer side walls 12 thereof are adjacent to each other and also in a manner as the spaced distance between two adjacent bodies are mated with the spaced distance between two adjacent sets of metallic electrodes 2 pairs with the fusible wires 5 respectively gripped thereby. The saddle parts 21 of the pair of the metallic electrodes 2 having the fusible wire 5 gripped thereby are then fitted onto the opposite shorter side walls 11 of the body 1 and fixedly mounted. These steps are performed as continuous processes. In the course of this step, the fusible wire 5 is extended in the space 6 of the body 1 in a floating condition. Next, as shown in FIG. 6, the protruded side of the lid portion 3 is put in the opening of the body 1 and pressed to such a degree as the flat surface of the lid portion 3 is slightly sunken relative to the top surface of the longer side walls 12 of the body 1. At this time, each of the third portions of the saddles parts 21 of the metallic electrodes 2 is sandwiched by the inner surface of the respective shorter side wall 11 of the body 1 and the respective end surface 32 (see FIG. 5) of the lid portion 3 and fixed therein. Also, the flat surfaces 31 are respectively rested on the upper surfaces of the resting portions 14 of the body 1. As shown in FIGS. 2A and 2B, as the flat surface of the lid portion 3 is pressed to a position where the flat surface is slightly sunken relative to the top surface of the longer side walls 12 of the body 1, a shallow recess will be provided and when an adhesive material 4 is applied to the shallow recess or the flat surface of the lid portion 3, the adhesive material 4 may flow into the clearances between the side surfaces of the lid portion 3 and the longer side walls 12 of the body 1 and the third portion of the saddle part 21 of the metallic electrodes 2, and between the flat surfaces 31 of the lid portion 3 and the upper surfaces of the resting portions 14, and solidified to fix such adjacent components. As the consequence, a space 6 of the body 1 can be positively sealed. Since the above-mentioned processes can be easily executed with continuous processes, productivity can be enhanced.

Figure 7:
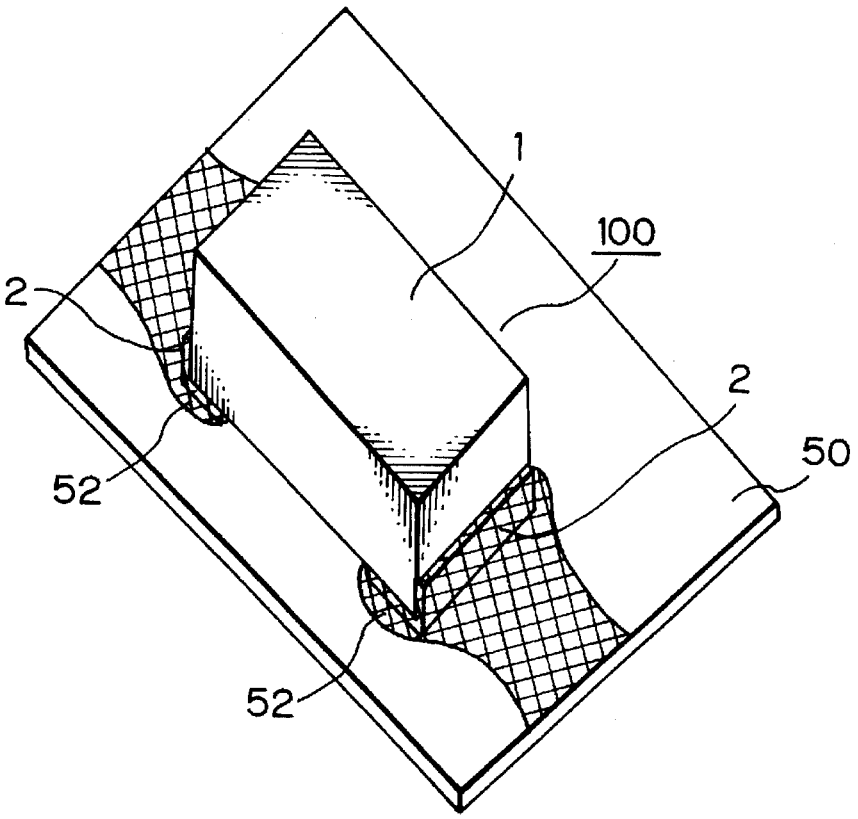
FIG. 7 illustrates how the surface-mount type microminiature electric current fuse shown in FIG. 1 is fixed and electrically connected for use by soldering to pads of a pattern formed on a printed circuit substrate.

FIG. 7 illustrates the manner in which the surface-mount type microminiature electric current fuse shown in FIG. 1 is fixed and electrically connected for use by soldering to pads of a pattern formed on a printed circuit substrate. In FIG. 7, the reference numeral 100 designates the surface-mount type microminiature electric current fuse shown in FIG. 1, the reference numeral 50 a printed circuit substrate, and the reference numeral 52 pads.

Figure 8:
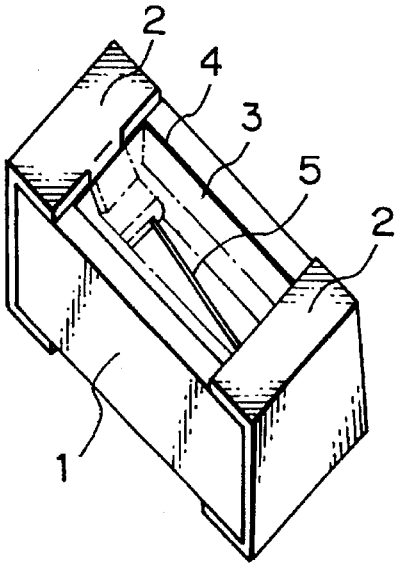
FIG. 8 is a perspective view showing a surface-mount type microminiature electric current fuse according to a second embodiment of the present invention.
Figure 9:
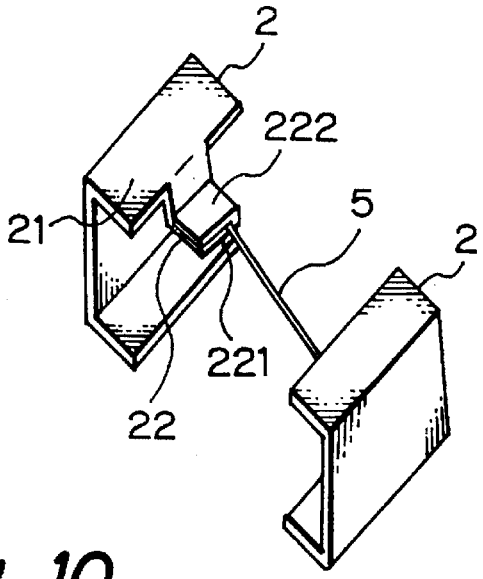
FIG. 9 illustrates a pair of metallic electrodes and a fusible wire which are components of the surface-mount type microminiature electric fuse according to the second embodiment of the present invention shown in FIG. 8, the opposite end portions of the fusible wire being shown as gripped by the pair of the metallic electrodes.
Figure 10:
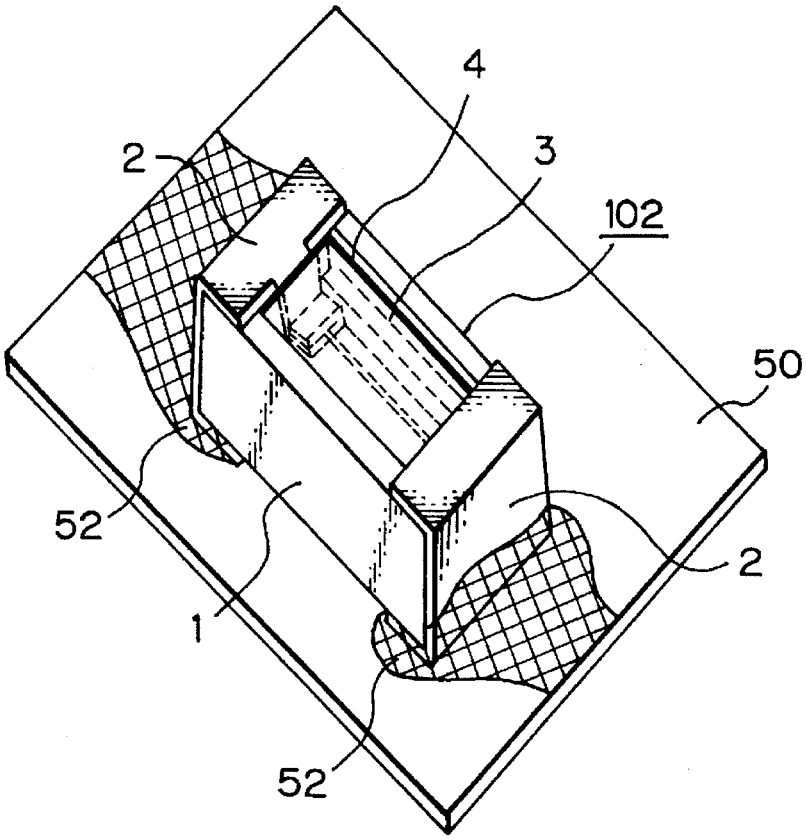
FIG. 10 is a perspective view showing how the surface-mount type microminiature electric current fuse according to the second embodiment of the present invention shown in FIG. 8 is fixed and electrically connected for use by soldering to pads of a pattern formed on a printed circuit substrate.

FIG. 8 is a perspective view illustrating a surface-mount type microminiature electric current fuse according to a second embodiment of the present invention. FIG. 9 illustrates a pair of metallic electrodes and a fusible wire which are components for the surface-mount type microminiature current fuse according to the second embodiment of the present invention shown in FIG. 8, the electrodes and fusible wire being illustrated with opposite ends of the fusible wire being gripped by the pair of metallic electrodes. FIG. 10 is a perspective view showing the manner in which the surface-mount type microminiature electric current fuse according to the second embodiment of the present invention shown in FIG. 8 is fixed and electrically connected for use by soldering to pads of a pattern formed on a printed circuit substrate. In FIG. 10, the reference numeral 102 designates the surface-mount type microminiature electric current fuse shown in FIG. 8.

The difference of the second embodiment from the first embodiment is that the portion of the metallic electrode 2 which is in contact with the outer surface of the shorter side wall 11 of the body 1 extends as far as to the bottom portion of the body 1 and further is bent to extend along a part of the bottom portion, the lid portion 3 is made of a transparent insulating material, the adhesive material 4 is transparent and that portion of the fuse to be soldered to a printed substrate is located at the side of the bottom portion of the body 1 rather than at the side of the opening of the body 1 as in the case of the first embodiment. Other aspects than the above are the same as those of the first embodiment. When the lid portion 3 and the adhesive material 4 are transparent, the interior of the body 1 can be observed from the outside as shown in FIG. 8 and whether the fusible wire 5 is properly extended or not readily can be determined.

The continuous working and assembly processes to form the surface-mount type microminiature electric current fuse according to the second preferred embodiment are identical or similar to those of the first embodiment as described above.

What is claimed is:

1. A surface-mount type microminiature electric current fuse comprising:

a body having a substantially rectangular parallelepiped box like configuration having two opposing shorter side walls, two opposing longer side walls and a bottom part, said body being made of a heat resistant, electrically insulating material and having resting portions, each of which extends from the inner surface of each of said longer side walls of said body toward a space defined in said body and forming a stepped portion relative to the top surfaces of said longer side walls;

a fusible wire;

a pair of metallic electrodes including respective integral metallic sheets and disposed at said shorter side walls of said body; and a lid portion made of a heat resistant and electrically insulating material, the cross-section of said lid portion having a convex shape to be fitted in an opening of said body; and wherein each of said pair of metallic electrodes includes a saddle part having a saddle shape to be fitted onto the top surface of both side surfaces of the respective said shorter side wall of said body, and a fusible wire gripping part extending from the end portion of said saddle part at the side facing said space of said body into said space with the width of said fusible wire gripping part being narrower than the width of said end portion of said saddle part when said saddle part of said metallic electrode is fitted onto said shorter side wall of said body;

each said fusible wire gripping part has a first sheet portion extending within said space, and a second sheet portion which is bent and extends from said first sheet portion in a direction different from the direction of said first sheet portion extending into said space and cooperates with said first sheet portion so as to grip the end of said fusible wire;

said pair of metallic electrodes gripping the opposite ends of said fusible wire with said fusible wire gripping part are respectively disposed at the shorter side walls of said body so that the opposite ends of said fusible wire are gripped by said fusible wire gripping parts so as to extend said fusible wire through said space of said body;

said lid portion is pressed to such an extend that the flat surface of said lid portion is sunken to a location slightly lower relative to the top surfaces of said longer side walls of said body, and flat planes of the convex portion of said lid portion are respectively placed on the upper surfaces of said resting portions of said body while an adhesive is applied so that said space of said body is sealed and said lid portion is fixed to said body; and each of said pair of metallic electrodes is sandwiched and fixed by a respective inner surface of said shorter side wall and a respective end surface of said lid portion in the longitudinal direction.

2. A surface-mount type microminiature electric current fuse as claimed in claim 1 wherein each of of said metallic electrodes includes a portion disposed at the outer side of the respective said shorter side wall of said body and extending to the bottom part of said body along said shorter side wall and bent at said bottom part, further extending along a part of said bottom part, and said lid portion and said adhesive are transparent.

* * * * *